United States Patent [19]

Lam et al.

[11] Patent Number: 5,026,493

[45] Date of Patent: Jun. 25, 1991

[54] REDUCED ASH CONTENT LUBRICANTS

[75] Inventors: William Y. Lam, Ballwin; David L. Wooton, St. Louis, both of Mo.

[73] Assignee: Ethyl Petroleum Additives, Inc., St. Louis, Mo.

[21] Appl. No.: 535,780

[22] Filed: Jun. 11, 1990

Related U.S. Application Data

[63] Continuation-in-part of Ser. No. 388,843, Aug. 3, 1989, abandoned.

[51] Int. Cl.[5] ..... C10M 141/02

[52] U.S. Cl. ..... 252/32.7 HC; 252/33.4; 252/46.3; 252/46.6

[58] Field of Search ..... 252/32.7 HC, 33.4, 32.7 E, 252/46.3, 46.6, 48

[56] References Cited

U.S. PATENT DOCUMENTS

| | | | |
|---|---|---|---|
| 2,316,080 | 4/1943 | Loane et al. | 252/48 |
| 2,367,468 | 1/1945 | Mixon et al. | 252/48 |
| 2,476,812 | 7/1949 | Buckmann et al. | 252/32.7 E |
| 2,809,934 | 10/1957 | Alford et al. | 252/32.7 |
| 2,969,324 | 1/1961 | Knapp et al. | 252/32.7 E |
| 3,089,851 | 5/1963 | Klass et al. | 252/32.7 |
| 4,116,873 | 9/1978 | DeVries | 252/33 |
| 4,159,956 | 7/1979 | DeVries | 252/33.4 |
| 4,159,958 | 7/1979 | DeVries | 252/33.4 |
| 4,159,959 | 7/1979 | DeVries | 252/33.4 |
| 4,159,995 | 7/1979 | DeVries | 252/33.4 |
| 4,708,809 | 11/1987 | Davis | 252/33.4 |

FOREIGN PATENT DOCUMENTS

| | | |
|---|---|---|
| 1212462 | 11/1970 | United Kingdom . |
| 1246545 | 9/1971 | United Kingdom . |

*Primary Examiner*—Jacqueline V. Howard
*Attorney, Agent, or Firm*—David M. Bunnell

[57] ABSTRACT

A reduced metal content lubricant contains the reaction product of a phosphosulfurized polyalkene and an amine, a polyalkene substituted phenol, and, optionally, a polyalkene sulfonate.

29 Claims, No Drawings

REDUCED ASH CONTENT LUBRICANTS

RELATED APPLICATION

This application is a continuation-in-part of application Ser. No. 388,843 filed Aug. 3, 1989 now abandoned whose teachings are incorporated herein by reference.

BACKGROUND OF THE INVENTION

This invention relates generally to lubricating oil compositions and more particularly to additive combinations containing functionalized polyalkenes which impart dispersancy, detergency, antioxidant, and antiwear properties to lubricating oils. Such additive containing oils are especially suitable for use as crankcase lubricants.

Current crankcase lubricating oils must operate under high temperature conditions for extended periods between oil changes and still provide protection against engine wear and deposits such as sludge and varnish. Commercial lubricants usually include, besides alkenylsuccinimide or Mannich base dispersants, a zinc dialkyldithiophosphate and an overbased alkali or alkaline earth metal sulfonate or phenate to provide wear, detergency and acid neutralizing properties. Such materials are traditionally thought to be essential ingredients in such lubricants.

BRIEF SUMMARY OF THE INVENTION

We have now found a new lubricant additive combination which has a very low metal content and still provides lubricant properties which are equivalent to traditional formulations.

In accordance with this invention, there is provided a lubricant composition comprising a major amount by weight of oil of lubricating viscosity and a minor amount by weight of a combination of an animated phosphosulfurized polyalkene and a polyalkene substituted phenol.

In another aspect of this invention there is provided a lubricant composition comprising a major amount by weight of oil of lubricating viscosity and a minor amount by weight of a combination of an animated phosphosulfurized polyalkene, a polyalkene substituted phenol, and a polyalkene sulfonate. Also provided are lubricant additive concentrates which contain the above combinations.

DETAILED DESCRIPTION

The polymers which are functionalized to form the additive ingredients of the invention include polyalkene homopolymers or copolymers having number average molecular weights ranging from about 700 to 5,000 (about 50 to 360 carbon atoms) and preferably 900 to 2,500 which are preferably derived from monoolefins having from about 2 to 30 carbon atoms; usually 4 to 6 carbon atoms and most preferably derived from terminal or mixed terminal-internal olefins such as ethylene, propylene, butene-1, butadiene-1,3, pentadiene-1,3, and isobutylene. The polyalkenes can contain aromatic and cycloaliphatic groups as well as non-hydrocarbon groups which do not interfere with the formation of the polyalkene derivatives which form the components of the lubricant additive composition of the invention. Such groups include, for example, halo and preferably chlorine and fluorine, lower alkoxy, lower alkyl mercapto, hydroxy, mercapto, nitro, cyano, oxo (i.e. keto and aldehydo), and carboalkoxy groups. Such groups normally will not contribute more than 10% by weight of the total weight of polyalkenes. The alkyl moieties associated with such groups contain from 1 to 8 carbon atoms.

Specific examples of polyalkenes include polypropylenes, polybutenes, ethylene-propylene copolymers, styrene-isobutene copolymers, isobutene-butadiene-1,3 copolymers, propene-isoprene copolymers, isobutylene-chloroprene copolymers, copolymers of octene-1 with hexene-1 and terpolymers of isobutylene, cyclohexene and propylene. Preferred are polyisobutenes having number average molecular weights ranging from about 1,000 to 2,500 which polymers are commercially available.

The phosphosulfurized polyalkenes can be formed, as known in the art by reacting the polyalkene polymer with a phosphorus sulfide such as $P_4S_3$ and $P_4S_7$, with phosphorus pentasulfide, $P_2S_5$ ($P_4S_{10}$), being preferred. The phosphorus sulfide can be used in amounts ranging from about 1 to 50% by weight of polymer with amounts of from about 3 to 15% being preferred. The reaction temperature can range from about 100° to 300° C. with about 200° to 230° C. being preferred.

The phosphosulfurized polyalkene intermediate is then treated with a primary or secondary aliphatic or aromatic amine and, preferably, a polyamine containing 2 or more and usually 2 to 6 amine groups, in amounts of from about 0.4 to 2.0 mole per mole of phosphosulfurized polyalkene intermediate so as to provide a substantially neutralized product based on the total acid number of the intermediate. Mixtures of amines can be used. Specific examples of polyamines which can be used include alkylene polyamines such as ethylene diamine, propylene diamine, diethylene triamine, diamylene triamine, triethylene tetramine, tripropylene tetramine, diethylene propylene tetramine, tetraethylene pentamine, tetrabutylene pentamine, butylene diamine, dihexylene triamine and the like. Also included are alkylene polyamines which are substituted with one or more hydroxygroups, and mixtures of any of the above.

Specific examples of suitable mono-amine and additional polyamine reactants which can be used in the practice of the present invention include methylamine, ethylamine, propylamine, isopropylamine, n-butylamine, sec-butylamine, isobutylamine, pentylamine, hexylamine, cyclohexylamine, heptylamine, octylamine, dodecylamine, octadecylamine, eicosylamine, triacontanylamine, benzylamine, chlorobenzylamine, nitrobenzylamine, 2-ethoxyethylamine, 4-carbomethoxyhexylamine, dimethylamine, diethylamine, dialkanol amines, diethanol amine, di-n-propylamine, diisopropylamine, di-n-butylamine, di-sec-dutylamine, diisobutylamine, di-tert-butylamine, dipentylamine, dihexylamine, dioctylamine, dieicosylamine, ditriacontanylamine, N-methylethylamine, N-methylpropylamine, N-methyloctadecylamine, N-ethylhexylamine, N-ethyldodecylamine, N-propyldodecylamine, aniline, toluidine (o-, m-, or p-), 2,4-xylidine, 3,4-xylidine, 2,5-xylidine, 4-ethylaniline, 3-propylaniline, 1,3-diamino benzene, 4,4'-diamino-diphenyl methane, p-chloro aniline, 2,6-diamino toluene, 4,4'-diaminodiphenyl, 2,4,4'-triamino diphenyl ether, 2,6-diamino naphthalene, 1,5-diamino-2-methylpentane, phenylethyl amine, piperidine, morpholine, piperazine, glycine, 2-amino ethyl ether, 2-amino ethyl sulfide, and the like.

The polyalkene sulfonate can be an alkali or alkaline earth metal sulfonate salt or ashless sulfonate formed by reaction of the sulfonic acid with inorganic bases such as zinc oxide, magnesium hydroxide, calcium hydroxide, or calcium oxide or organic reagents such as amines, alkanols, olefins and the like. The polyalkene sulfonate can be formed from an alkyl, aryl, or alkaryl sulfonic acid which contains a polyalkene polymer group such as polyalkene sulfonic acid, polyalkene benzene sulfonic acid, and polyalkene naphthalene sulfonic acid. The term polyalkene sulfonate as used herein, therefore, includes both aliphatic and aromatic sulfonates. The alkali or alkaline earth metal salts of the sulfonated aliphatics can be formed, as known in the art, by reacting the polyalkene polymer with a sulfonating agent such as chlorosulfonic acid, sulfur trioxide, sulfuric acid or oleum to form a polyalkene sulfonic acid and then treating the acid with an inorganic base. The sulfonated aromatics can be similarly prepared, for example, by sulfonation of alkylated benzenes or other aromatics. The ion of the metal salt can be any alkali or alkaline earth metal which forms a salt which will function as a detergent in lubricating oil compositions. Preferred are Group II metals and especially calcium or magnesium. The salts can be neutral or overbased but overbasing is not necessary to give a satisfactory result.

The polyalkene substituted phenols can be formed, as known in the art, by reaction of the polyalkene with a phenol by Friedel-Crafts reaction using a Lewis acid catalyst such as $BF_3$. The phenol, which has at least one hydroxyl group, preferably 1 to 2 hydroxy groups, directly linked to an aromatic nucleus such as benzene or naphthalene, can optionally contain other substituents such as lower ($C_1$–$C_8$) alkyl, lower ($C_1$–$C_8$) alkoxy, halo and various combinations thereof and suitable polyalkene phenols also include condensation products of the phenol with an aldehyde such as formaldehyde or an aldehyde and an amine according to the Mannich condensation reaction.

The additives can be used in mineral oils or in synthetic oils of suitable viscosity for the desired application. Crankcase lubricating oils have a viscosity up to about 80 SUS at 10° F.

Preferred crankcase lubricating oils for use in the invention have a viscosity up to about SAE 40. Sometimes such motor oils are given a classification at both 0° and 210° F., such as SAE 10W-40 or SAE 5W-30.

Mineral oils include those of suitable viscosity refined from crude oil from all sources including Gulfcoast, midcontinent, Pennsylvania, California, Alaska and the like. Various standard refinery operations can be used in processing the mineral oil.

Synthetic oil includes both hydrocarbon synthetic oil and synthetic esters. Useful synthetic hydrocarbon oils include polymers of alpha-olefins having the proper viscosity. Especially useful are the hydrogenated liquid oligomers of $C_{6-12}$ alpha-olefins such as alpha-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are also useful. For example, blends of 5–25 wt % hydrogenated alphadecene trimer with 75–95 wt % 150 SUS (100° F.) mineral oil. Likewise, blends of about 5–25 wt. % di-(2-ethylhexyl)adipate with mineral oil of proper viscosity results in a useful lubricating oil. Also, blends of synthetic hydrocarbon oil with synthetic esters can be used. Blends of mineral oil with synthetic oil are useful when preparing low viscosity oil (e.g. SAE 5W-30) since they permit these low viscosities without contributing excessive volatility.

Besides the functionalized polyalkene components, the lubricants of the invention can contain other additives conventionally added to such compositions for example; antioxidants such as sulfurized alkyl phenols, hindered phenols and alkyl diphenyl amines; friction reducers such as sulfurized fatty acid amides, esters, oils, and olefins; detergents such as metal-containing or ashless phenates; anti-wear agents such as sulfurized phosphites, acid phosphites and phosphates and ashless thiophosphates; viscosity index improvers such as the polyalkylmethacrylate type, the ethylene-propylene copolymer type, including graft copolymers with an N-allyl amide such as diallyl formamide, or the styrene-diene or styrene-acrylate copolymer type; pour point depressants such as alkyl methacrylate copolymers, polyacrylamides, and Friedel-Crafts Condensation products of chlorinated wax with naphthalene or phenol, and antifoam agents such as silicones or acrylate copolymers.

Conventional blending equipment and techniques may be used in preparing the lubricating oil compositions of the present invention. In general, a homogeneous blend of the foregoing polyalkene derived components is achieved by merely blending the components separately, together or in any combination or sequence with the lubricating oil in a determined proportion sufficient to provide the lubricating oil composition with the desired properties. This is normally carried out at ambient temperature to about 70° C. The selection of the particular base oil and components, as well as the amounts and ratios of each, depends upon the contemplated application of the lubricant and the presence of other additives. In general, however, the amount of phosphosulfurized polyalkene-amine component in the lubricating oil can vary from about 1.0 to 1% and preferably from about 3 to 6 weight percent based on the weight of the final lubricating oil composition. Likewise the amount of polyalkene sulfonate can vary from about 0 to 5.0 preferably 0.1 to 5.0 and more preferably from about 0.5 to 3.0 weight percent and the amount of polyalkene phenol can vary from about 0.5 to 5.0 and preferably from about 1 to 3 weight percent. The metal content of the lubricant can be very low i.e. 0 to 200 ppm of finished oil.

In many cases, a preferred way to add the additives to lubricating oil is in the form of an additive package. These are concentrates dissolved in a diluent such as mineral oil, synthetic hydrocarbon oils and mixtures thereof which, when added to a base oil, will provide an effective concentration of the three types of polyalkene based additives and other known conventional additives such as those listed above. The various additives are present in a proper ratio such that when a quantity of the concentrate is added to lubricating oil the various additives are all present in the proper concentration. For example, if the desired use level of a particular additive component is 0.2 wt. % and the final formulated oil is made by adding 10 parts of the additive package to 90 parts of base lubricating oil, then the additive package will contain 2.0 wt. % of that particular additive component. Usually the concentrate will be 95.0 to 99.9 percent by weight additive composition and from 5.0 to 0.1 percent by weight lubricating oil diluent. Preferably, the additive composition comprises 97 to 99 percent by weight of the lubricating oil additive concentrate. This concentrate is diluted with additional lubricating oil before use such that the finished lubricating oil product contains from about 5.0 to 25.0 percent by weight of concentrate. Accordingly, typical amounts of phosphosulfurized polyalkene-amine dispersant in a concentrate would range from about 30 to 80 weight percent of total concentrate, typical amounts of polyalkene sulfonate would range from about 5 to 30 weight percent of total concentrate and typical amounts of polyalkene phenol would range from about 5 to 30 weight percent of total concentrate.

The invention is further illustrated by, but is not intended to be limited to, the following examples wherein percentages and parts are by weight unless otherwise indicated.

EXAMPLE 1

Preparation of Phosphosulfurized Polyalkene

Polybutene ($\overline{M}_n$=1483), 1083.2 grams, 0.72 mole, was added to a two liter reactor and heated to 225° C. The portion-wise addition of 81 grams, 0.36 mole, of $P_2S_5$ was started when the temperature reached 160° C. and completed after 10 minutes when the temperature had reached 200° C. The reaction mixture was held at 225° C. for 2 hours. The reaction mixture was then purged with nitrogen at 225° C. for 1 hour and the resulting material was filtered through a Whatman No. 54 paper coated with filter aid to provide the phosphosulfurized polybutene product which had a total acid number TAN of 19.2 mg KOH/gram.

Amine Treatment of Phosphosulfurized Polyalkene

Phosphosulfurized polybutene, 769.8 grams, prepared above and diluted with 25 grams of process oil #5 was added to a two liter flask and heated to 155°-160° C. A charge of 31.2 grams of mixed ethylene polyamine, avg. mol. wt. 189.3, was added dropwise over a period of about 20 minutes. Vacuum was then gradually applied to the resulting batch at 155° C. When full vacuum (20mm Hg) was attained after about 20 minutes the batch was held under vacuum for 2 hours and then purged with nitrogen for 30 minutes. The resulting ashless dispersant was diluted with 175.2 grams of process oil #5 to make a product with 80 weight percent active dispersant. The diluted product was then filtered through a Whatman No. 54 paper coated with filter aid to provide a clear, amber, viscous liquid.

Preparation of Polyalkene Calcium Sulfonate

To a one liter reactor were added 394.4 grams, 0.27 mole, of polybutene ($\overline{M}_n$=1483), 43.8 grams of process oil #5 and the mixture was heated to 55°-60° C. When the temperature reached 57° C., 31.0 grams, 0.27 mole, of chlorosulfonic acid was added dropwise over a period of 1.5 hours with the temperature held at 55°-58° C. A dark reddish purple liquid was formed. The offgas was trapped by a NaOH scrubber and a drop of antifoam was added to the reaction mixture to control foaming. After adding the chlorosulfonic acid, the reaction mixture was kept at a temperature of 55°-58° C. for 15 minutes and then allowed to cool to room temperature and stand overnight. The reaction mixture was reheated to 60° C. and purged with nitrogen for 15 minutes. Excessive foaming occurred and the nitrogen purge was discontinued. The product had a TAN of 26.0 mg KOH/gram and contained 1.4% sulfur and 0.86% chlorine by weight.

To a one liter reactor were added 180.4 grams of the polybutene sulfonic acid prepared above and 130 grams of hexane. The resulting solution was heated to 50°-55° C. and a slurry of 9.3 grams of CaO in 130 mL methanol, 4 grams of water and about 0.5 mL of concentrated ammonium hydroxide solution were added in one portion to the sulfonic acid - hexane solution. The resulting mixture was heated to a gentle reflux (54.5° C.) for about 2 hours. A yellow reaction product was formed. The solvent was distilled off until the batch temperature reached 70° C. and vacuum (30 mmHg) was applied to strip more solvent. After stripping, about 180 grams of process oil #5 was added to dilute the reaction product to approximately 50 weight percent active material. The resulting diluted polybutene Ca sulfonate product was filtered through a Whatman No. 54 paper coated with filter aid to give a clear, dark brown liquid which had a TAN of 5.3 mg KOH/gram, and contained 0.5% by weight sulfur and 0.25% by weight calcium.

A crankcase oil was prepared using the animated phosphosulfurized polybutene and polybutene calcium sulfonate products prepared above and blending them with a polybutyl phenol in a 100 neutral oil along with a VI improver to prepare a low ash 10W-30 grade finished oil for testing having the following composition:

| Ingredient | Wt % Finished Oil |
|---|---|
| 100 Neutral oil | 80.0 |
| Aminated phosphosulfurized polybutene dispersant | 5.0 |
| Polybutene Ca sulfonate detergent | 1.6 |
| Polybutyl phenol[1] | 2.18 |
| Co-sulfurized fatty acid amide-fatty acid ester | 0.50 |
| Sulfurized phenolic antioxidant | 0.50 |
| Dow Corning antifoam 4% | 0.013 |
| Process oil #5 | 0.207 |
| VI improver | 10.00 |
| Total | 100.0 |

[1]Based on $\overline{M}_n$ = 900 polyisobutylene substituted phenol containing 45.8% active ingredient thus providing about 1.0% active in finished oil.

EXAMPLES 2-7

Preparation of Phosphosulfurized Polyalkene (A)

To a 5-L reactor were added 1990.4 grams of polybutene ($\overline{M}_n$=1483) and 2 drops of concentrated antifoam (DCF, ~0.1 g) and the material was heated gradually to 210° C. under $N_2$ atmosphere. Beginning at 160° C., 149 grams $P_2S_5$ were added portionwise over a period of about 20 minutes. The batch temperature reached 205° C. at the end of $P_2S_5$ addition. The resulting batch was held at 210° C. for 30 minutes and then at 225° C. for 1.5 hours. $N_2$ was then purged through the batch for 1 hour (wt. of crude product=2108.7 g). Process oil No.5 (233.3 g) was added to make a product containing about 90 wt. % active material, which was filtered through a Whatman No. 54 paper coated with filter-aid. A clear amber viscous liquid product (2296g) was collected which had a total acid number TAN 14.0 mg KOH/g and contained 3.4 wt % S and 1.74 wt % P.

Preparation of Phosphosulfurized Polyalkene (B)

To a 3-L reactor were added 1371.1 grams of polybutene ($\overline{M}_n$=2634) and 2 drops of concentrated DCF and the material was heated gradually to 220° C. Beginning at 195° C., 59.0 grams of $P_2S_5$ were added portionwise over a period of about 10 minutes. The resulting batch was held at 220° C. for 30 minutes and was then heated to 225° C. After holding at 225° C. for 1-5 hours, $N_2$ was purged through the batch for 1 hour. Process oil #5 (187.5 g) was then added to the resulting batch (1417.6 g) to make a product containing about 90 wt. % active material, which was filtered through a filter-aid coated paper. The filtered product which had an avg. TAN of 11.55 mg KOH/g turned into a cloudy viscous liquid upon cooling.

Preparation of Animated Phosphosulfurized Polyalkenes

I. To a 250 mL reactor were added 101.4 grams of the phosphosulfurized polybutene prepared in A above and heated to 150°-155° C. Tertiary alkyl, fatty ($C_{12-14}$) primary amine (4.8 grams) was added slowly over a period of about 3 minutes. The resulting batch was heated at 155° C. under full vacuum for about 2 hours. Process oil #5 (13.5 g) was added to the resulting material (~104.6 g) to make a batch containing about 80 wt. % active material. The diluted product was then filtered through a filter-aid coated Whatman No. 54 paper. A clear amber liquid product (I) was obtained.

II. To a 250 mL reactor were added 92.3 grams of the phosphosulfurized PIB prepared in A above and the material was heated to 150°-155° C. Diethylenetriamine (1.6 grams) was added dropwise over a period of 1 minute. The resulting batch was held at 150°-155° C. under full vacuum for 2.0 hours. Process oil #5 was added to the material to make a batch containing about 80 wt. % active product. The product, (II) was collected without filtration.

III. To a 250 mL reactor were added 91.9 grams of the phosphosulfurized PIB prepared in A above and heated to 150°-155° C. Tetraethylenepentaamine (2.9 grams) was added slowly over a period of 4 minutes. The batch temperature momentarily was heated up to 170° C. The batch was cooled back at 155° C. as polyamine addition continued. The resulting batch was held at 155° C. under full vacuum for 1.5 hours. Process oil #5 was added to the stripped material to make a batch containing about 80 wt. % active product (III) which was collected without filtration.

IV. To a 250 mL reactor were added 91.0 grams of the phosphosulfurized PIB prepared in A above and the material was heated gradually to 150°-155° C. At 75° C., ethylenediamine (0.9 g) was added dropwise over a period of about 2 minutes. The resulting batch was held at 150°-155° C. under full vacuum for 2 hours. Process oil #5 was added to the batch to make a material containing about 80 wt. % active product (IV) which was collected without filtration.

V. To a 250 mL reactor were added 129.1 grams of the phosphosulfurized PIB prepared in B above and the sample was heated to 155°-160° C. A mixed ethylene polyamine (3.3 grams) was added dropwise over about 3 minutes. The resulting batch was then held at full vacuum (30 mm Hg) at 155°-160° C. for 2 hours. $N_2$ was allowed to purge through the batch for 30 minutes. Process oil #5 was added to the resulting batch (~132 g) to make a material containing about 80 wt. % active product (V) which was collected without filtration.

VI. To a 2-L reactor were added 1200.7 grams of the phosphosulfurized PIB prepared in B above and the material was heated to 155°-160° C. Diethylenetriamine (16.9 grams) was added slowly over a period of 15 minutes. Vacuum was gradually applied to the resulting batch until full vacuum (25 mm Hg) was obtained. The batch was then held for 2 hours under vacuum followed by a $N_2$ purge for 30 minutes. Process oil #5 was added to the resulting batch to make a product VI containing about 80 wt. % active material which was collected without filtering.

Preparation of Polyalkene Calcium Sulfonate

To a 2-L reactor were added 745 grams of polybutene (Mn=1483) and the batch Was heated to 55°-60° C. $ClSO_3H$ (58.5 grams) was added dropwise over a period of 2 hours. The off gas was scrubbed by NaOH solution. The resulting batch was allowed to cool to room temperature and stand under $N_2$ atmosphere overnight. The batch was heated to 70° C. and vacuum was gradually applied to avoid excessive foaming over a period of about 45 minutes. The maximum vacuum obtained before excessive foaming occurred was 24 mm Hg. The resulting dark purplish viscous liquid was collected without filtration. The product weighed 796.1 grams.

To a 3L reactor were added 740 grams of the above chlorosulfonated PIB product and 730 grams of hexane. To the resulting solution was added a slurry of 20 grams of CaO in a methanol (485 grams), water (15 grams), and concentrated $NH_4OH$ (3 mL) mixture. The resulting batch, which turned from purplish to yellow, was heated to a gentle reflux (51° C.) and held for 2 hours. The solvent was distilled until the temperature reached 70° C. Vacuum was applied to the remaining batch to further remove residual solvent until the temperature rose back to 70° C. again. Vacuum stripping was continued until the batch temperature reached 90° C. at which the batch was held for 30 minutes. Process oil #5 (740 g) and about 15 g of filter-aid (Celite) were added to the stripped material and the batch was vacuum stripped at 90° C. for an additional 30 minutes. The resulting material was filtered through a filter-aid coated Whatman No.54 paper. The weight of filtered product collected was 1397.1 g.

Oil Blends

Six oil blends (Examples 2 to 7) were prepared, using the sulfonate prepared above, and bench tested. The blends each contained the same proportions of ingredients but each had 5 wt. percent of a different one of the animated phosphosulfurized polybutene dispersants (I-VI) prepared above. The compositions were as follows:

| Ingredient | Wt % Finished Oil |
|---|---|
| 100 Neutral oil | 80.0 |
| Polybutene Ca sulfonate detergent | 1.6 |
| Polybutyl phenol[1] | 2.18 |
| Co-sulfurized fatty acid amide-fatty acid ester | 0.50 |
| Sulfurized phenolic antioxidant | 0.50 |
| Dow Corning antifoam 4% | 0.013 |
| Process oil #5 | 0.207 |
| VI improver | 10.00 |
| Aminated phosphosulfurized polybutene dispersant | 5.00 |

-continued

| Ingredient | | Wt % Finished Oil |
|---|---|---|
| | Total | 100.00 |

[1]Based on $\overline{M}_n$ = 900 polyisobutylene substituted phenol containing 45.8% active ingredient thus providing about 1.0% active in finished oil.

Hot Oil Oxidation Test (HOOT)

The above oil blends along with a sample of oil from Example 1 were submitted to a 64 hour HOOT (hot oil oxidation test) in duplicate. According to this test, fully formulated mineral lubricating oil samples are prepared and 25 grams of each sample is placed in a test cell together with 0.27 gram of a catalyst composition prepared by dissolving 6.65 grams of ferric acetylacetonate and 0.6 gram of cupric acetylacetonate in 100 grams of xylene. The cell is heated to 160° C. and air is blown through the heated oil for 64 hours at a rate of 10 liters/-hour. The percent viscosity increase is measured at 40° C. The results are reported in Table I below:

TABLE I

| Example | Vis @ 40° C. | % Change |
|---|---|---|
| 1 | 72.79 | Fresh |
| 1A | 70.87 | −3% |
| 1B | 70.87 | −3% |
| 2 | 71.77 | Fresh |
| 2A | 78.47 | 9% |
| 2B | 73.20 | 2% |
| 3 | 71.76 | Fresh |
| 3A | 74.32 | 4% |
| 3B | 72.70 | 1% |
| 4 | 71.69 | Fresh |
| 4A | 69.62 | −3% |
| 4B | 69.52 | −3% |
| 5 | 71.74 | Fresh |
| 5A | 73.83 | 3% |
| 5B | 74.80 | 4% |
| 6 | 77.11 | Fresh |
| 6A | 74.23 | −3% |
| 6B | 75.81 | −3% |
| 7 | 78.09 | Fresh |
| 7A | 73.91 | 1% |
| 7B | 69.00 | −6% |

Sludge Bench Test

The oil blends (Examples 1–7) were submitted to a sludge bench test. In this test after a 64 hour HOOT, the change in dielectric constant of the oil is determined. The oxidized oil is mixed with a known amount of standardized oxidized oil (a laboratory preparation) and diluted with a hydrotreated basestock. Turbidity measurements are then taken on the diluted samples to measure the change in turbidity over time. The dielectric constant measurements, HOOT time and turbidity data are combined into a single number for reporting and comparison purposes. A low number indicates better anti-sludge properties. The results are reported in Table II below. The duplicate HOOT samples from each example (1–7) were combined for testing.

TABLE II

| Example | Sludge Number |
|---|---|
| 1A & B | 46.3 |
| 2A & B | 59.6 |
| 3A & B | 47.2 |
| 4A & B | 52.8 |
| 5A & B | 46.6 |
| 6A & B | 66.1 |

TABLE II-continued

| Example | Sludge Number |
|---|---|
| 7A & B | 63.9 |

Comparison

The 64 hour HOOT and sludge bench tests were repeated using a formulation according to Example 1, a formulation according to Example 7, and two commercial type fully formulated 10W-30 oils containing succinimide dispersant, zinc dialkydithiophosphate (ZDDP), neutral and overbased calcium sulfonates, antioxidants, antifoam, pour point depressant and VI improver. The results are given in Table III below.

TABLE III

| Sample | 64 Hr HOOT Vis 40° C. | 64 Hr HOOT Vis % | Sludge Number |
|---|---|---|---|
| 1 | 76.5 | Fresh | — |
| 1A | 73.3 | −4.2 | 38.7 |
| 1B | 75.2 | −1.7 | |
| 7 | 82.7 | Fresh | — |
| 7A | 78.4 | −5.2 | 52.8 |
| 7B | 77.6 | −6.2 | |
| Commercial Oil #1 | 73.3 | Fresh | — |
| #1A | 733.4 | 894.8 | Heavy ppt |
| #1B | Too Thick | — | |
| Commercial Oil #2 | 67.5 | Fresh | — |
| #2A | 467.2 | 592.6 | Heavy ppt |
| #2B | 596.6 | 784.5 | |

As shown in Table III, the composition according to invention gave good viscosity and sludge results after 64 hour oxidation whereas the commercial oils failed, indicating that the compositions according to the invention provide lubricant oils having improved oxidation properties.

A standard ASTM sequence VE engine test was run using the finished oil of Example 1 as the crankcase lubricant for 288 hours. The following results were obtained:

| | Result |
|---|---|
| Sludge | |
| Rocker arm cover | 8.18 |
| Average | 8.95 |
| Clogging | |
| Oil screen sludge | 4% |
| Oil ring | 24% |
| Varnish | |
| Piston skirts | 6.75 |
| Average | 5.66 |
| Wear | 0.82 mils |
| Average cam lube | |

The test results showed that this oil formulation had good properties (close to meeting SG specifications for the test) although the oil ring clogging was high. The finished low ash oil contained only 60 ppm of calcium compared to normal metal concentrations in conventional crankcase lubricants of from 0.02 to 0.2 wt. percent zinc and 0.1 to 0.5 wt. percent calcium.

The compositions according to the invention also have the advantage of providing viscosity index improvement to the lubricant oils such that the amount of viscosity index improver can be reduced in obtaining comparable viscosity properties at different temperatures. Table IV below illustrates two formulations according to the invention compared to a commercial type 10W-30 oil containing a standard additive package including succinimide dispersant, ZDDP, neutral and overbased sulfonate, antioxidants, antifoam, and the indicated amounts of pour point depressant and viscosity index improver. The two formulations of the invention were similar to those of Examples 1 and 7 except for the different amounts of viscosity index improver as indicated in Table V below.

TABLE V

| Components/ Sample | VI LIFT Wt. Percent Commercial Oil | Ex 1 | Ex 7 |
|---|---|---|---|
| #5 base oil | 15 | 30 | 40 |
| #10 base oil | 85 | 70 | 60 |
| Pour point depressant | 0.2 | 0.2 | 0.2 |
| VI improver | 7.4 | 6.0 | 5.0 |
| DI Pack | | | |
| Commercial Oil | 8.3 | — | — |
| Ex 1 | — | 10.0 | — |
| Ex 7 | — | — | 10.0 |
| Viscosity | | | |
| 100° C. | 10.78 | 10.73 | 10.51 |
| 40° C. | 72.58 | 71.04 | 68.67 |
| −20° C. | 3316 | 3410 | 3404 |

The amount of viscosity index improver required in the commercial oil to achieve a 10W-30 oil was 7.4 weight percent, compared to amounts of 6.0 and 5.0 wt percent respectively needed to achieve a 10W-30 oil using the compositions of the invention. This shows a viscosity index benefit of about 19 and 32 percent, respectively, achieved by the compositions of the invention.

The invention, based on the above results not only provides low ash lubricating oils but oils having improved viscosity index and oxidation properties.

EXAMPLE 8

A crankcase oil was prepared using animated (mixed ethylene polyamine) phosphosulfurized polybutene prepared according to the process of Example 1 and the polyisobutylene substituted phenol as described in the prior Examples. These polyalkene ingredients were blended with other oil additives and submitted to a sludge bench test. The blended oil had the following composition:

| Ingredient | Wt % Finished Oil |
|---|---|
| 100 Neutral oil | 81.60 |
| Aminated phosphosulfurized polybutene dispersant | 5.00 |
| Polybutyl phenol[1] | 2.18 |
| Co-sulfurized fatty acid amide-fatty acid ester | 0.50 |
| Sulfurized phenolic antioxidant | 0.50 |
| Dow Corning antifoam 4% | 0.013 |
| Process oil #5 | 0.207 |
| VI improver | 10.00 |
| Total | 100.00 |

[1]Based on $\overline{M}_n$ = 900 polyisobutylene substituted phenol containing 45.8% active ingredient thus providing about 1.0% active in finished oil.

Two samples of the above composition which were submitted to a 64 Hour HOOT sludge bench test gave sludge numbers of 48.3 and 47.1 respectively or an average of 47.7. this demonstrates that the combination of an animated phosphosulfurized polyalkene and polyalkene phenol provided a good bench test sludge result.

We claim:

1. A lubricant composition comprising a major amount by weight of oil of lubricating viscosity and a minor amount by weight of an additive combination which comprises an animated phosphosulfurized polyalkene, a polyalkene substituted phenol and a polyalkene sulfonate, wherein the polyalkene groups have a number average molecular weight of from about 700 to 5,000.

2. The lubricant composition of claim 1 which includes, based on the total weight of composition, from about 1 to 10 weight percent animated phosphosulfurized polyalkene, from about 0.5 to 5.0 weight percent polyalkene substituted phenol and from about 0.1 to 5.0 weight percent polyalkene sulfonate.

3. The lubricant composition of claim 1 wherein the animated phosphosulfurized polyalkene is the reaction product of polybutene and $P_2S_5$ which has been treated with a polyamine.

4. The lubricant composition of claim 1 wherein the polyalkene substituted phenol is a polybutene substituted phenol.

5. The lubricant composition of claim 1 wherein the polyalkene sulfonate is a substantially neutral Group II metal polybutene sulfonate.

6. The lubricant composition of claim 2 wherein the polyalkene moieties are derived from polybutene having a number average molecular weight of from about 700 to 5,000, the animated phosphosulfurized polyalkene is the reaction product of polybutene and $P_2S_5$ which has been treated with from about 0.4 to 2.0 mole of amine per mole of reaction product and the polyalkene sulfonate is a substantially neutral calcium polybutene sulfonate.

7. The lubricant composition of claim 6 wherein the polybutene is polyisobutene and the amine is selected from mixed ethylene polyamine, diethylene triamine, tetraethylene pentaamine, ethylene diamine and tertiary alkyl fatty primary amine.

8. A lubricant additive concentrate comprising an animated phosphosulfurized polyalkene, a polyalkene substituted phenol, and a polyalkene sulfonate wherein the polyalkene groups have a number average molecular weight of from about 700 to 5,000.

9. A lubricant additive concentrate comprising a minor amount by weight of oil of lubricating viscosity and a major amount by weight of a mixture of animated phosphosulfurized polyalkene, polyalkene substituted phenol, and polyalkene sulfonate, wherein the polyalkene groups have a number average molecular weight of from about 700 to 5,000.

10. The lubricant additive concentrate of claim 9 which comprises, based on the total weight of concentrate, from about 30 to 80 weight percent animated phosphosulfurized polyalkene, from about 5 to 30 weight percent polyalkene substituted phenol and from about 5 to 30 weight percent polyalkene sulfonate.

11. The lubricant additive concentrate of claim 9 wherein the animated phosphosulfurized polyalkene is the reaction product of polybutene and $P_2S_5$ which has been treated with a polyamine.

12. The lubricant additive concentrate of claim 9 wherein the polyalkene substituted phenol is a polybutene substituted phenol.

13. The lubricant additive concentrate of claim 9 wherein the polyalkene sulfonate is a substantially neutral Group II metal polybutene sulfonate.

14. The lubricant additive concentrate of claim 10 wherein the polyalkene moieties are derived from polybutene having a number average molecular weight of from about 700 to 5,000, the animated phosphosulfurized polyalkene is the reaction product of polybutene and $P_2S_5$ which has been treated with from about 0.4 to 2.0 mole of amine per mole of reaction product and the polyalkene sulfonate is a substantially neutral calcium polybutene sulfonate.

15. The lubricant additive concentrate of claim 14 wherein the polybutene is polyisobutene and the amine is selected from mixed ethylene polyamine, diethylene triamine, tetraethylene pentaamine, ethylene diamine, diethanolamine, and tertiary alkyl fatty primary amine.

16. The composition of claim 2 wherein the metal content ranges from 0 to 200 ppm.

17. A lubricant composition comprising a major amount by weight of oil of lubricating viscosity and a minor amount by weight of an additive combination which comprises an animated phosphosulfurized polyalkene and a polyalkene substituted phenol wherein the polyalkene groups have a number average molecular weight of from about 700 to 5,000.

18. The lubricant composition of claim 17 which includes, based on the total weight of composition, from about 1 to 10 weight percent animated phosphosulfurized polyalkene and from about 0.5 to 5.0 weight percent polyalkene substituted phenol.

19. The lubricant composition of claim 17 wherein the animated phosphosulfurized polyalkene is the reaction product of polybutene and $P_2S_5$ which has been treated with a polyamine.

20. The lubricant composition of claim 17 wherein the polyalkene substituted phenol is a polybutene substituted phenol.

21. The lubricant composition of claim 18 wherein the polyalkene moieties are derived from polybutene and the animated phosphosulfurized polyalkene is the reaction product of polybutene and $P_2S_5$ which has been treated with from about 0.4 to 2.0 mole of amine per mole of reaction product.

22. The lubricant composition of claim 21 wherein the polybutene is polyisobutene and the amine is selected from mixed ethylene polyamine, diethylene triamine, tetraethylene pentaamine, ethylene diamine, diethanolamine, and tertiary alkyl fatty primary amine.

23. A lubricant additive concentrate comprising an animated phosphosulfurized polyalkene and a polyalkene substituted phenol wherein the polyalkene groups have a number average molecular weight of from about 700 to 5,000.

24. A lubricant additive concentrate comprising a minor amount by weight of oil of lubricating viscosity and a major amount by weight of a mixture of animated phosphosulfurized polyalkene and a polyalkene substituted phenol wherein the polyalkene groups have a number averages molecular weight of from about 700 to 5,000.

25. The lubricant additive concentrate of claim 24 which includes, based on the total weight of concentrate, from about 30 to 80 weight percent animated phosphosulfurized polyalkene and from about 5 to 30 weight percent polyalkene substituted phenol.

26. The lubricant additive composition of claim 24 wherein the animated phosphosulfurized polyalkene is the reaction product of polybutene and $P_2S_5$ which has been treated with a polyamine.

27. The lubricant additive composition of claim 24 wherein the polyalkene substituted phenol is a polybutene substituted phenol.

28. The lubricant additive concentrate of claim 25 wherein the polyalkene moieties are derived from polybutene and the animated phosphosulfurized polyalkene is the reaction product of polybutene and $P_2S_5$ which has been treated with from about 0.4 to 2.0 mole of amine per mole of reaction product.

29. The lubricant additive concentrate of claim 28 wherein the polybutene is polyisobutene and the amine is selected from mixed ethylene polyamine, diethylene triamine, tetraethylene pentaamine, ethylene diamine, and tertiary alkyl fatty primary amine.

* * * * *